US008371197B2

(12) United States Patent
Lee et al.

(10) Patent No.: US 8,371,197 B2
(45) Date of Patent: Feb. 12, 2013

(54) CUTTING EQUIPMENT

(75) Inventors: Feng-Chi Lee, Tu Cheng (TW); Kuo-chuan Chiu, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 348 days.

(21) Appl. No.: 12/876,088

(22) Filed: Sep. 3, 2010

(65) Prior Publication Data

US 2012/0055304 A1 Mar. 8, 2012

(51) Int. Cl.
*B26D 7/06* (2006.01)

(52) U.S. Cl. ..... 83/164; 83/278; 83/423; 83/649

(58) Field of Classification Search ..... 83/164, 83/207, 278, 423, 649
See application file for complete search history.

(56) References Cited

U.S. PATENT DOCUMENTS 5,483,857 A * 1/1996 Ziberna ..... 83/104
5,816,527 A * 10/1998 Nakae et al. ..... 242/527
6,332,387 B1 * 12/2001 Suhara ..... 83/100
2005/0172770 A1 * 8/2005 Kano et al. ..... 83/98
2008/0178723 A1 * 7/2008 Saimen ..... 83/523

* cited by examiner

*Primary Examiner* — Kenneth E. Peterson
(74) *Attorney, Agent, or Firm* — Cheng-Ju Chiang

(57) ABSTRACT

Provided is a cutting equipment for automatically cutting off workpieces from a material tape. The cutting equipment includes an electrical control box, a base board, a material-feeding mechanism, a material-transferring mechanism, a material-pulling mechanism and a cutting mechanism. The material-feeding mechanism includes a supporting bracket, a material disc and a disc-driving device. The material-transferring mechanism mounted on the base board includes a pad board, a first supporting board and a second supporting board. The material-pulling mechanism disposed above the material-transferring mechanism includes a driving component and a material-pulling component. The cutting mechanism mounted on the base board includes a lower supporting plate, an upper cutting plate and a transferring cylinder. The upper cutting plate disposes at least one cutting blade. The cutting equipment can enhance the working efficiency, reduce the defective rate and the manufacture cost, lighten the labor intensity of operators, and be suitable for mass production.

10 Claims, 10 Drawing Sheets

CUTTING EQUIPMENT

BACKGROUND OF THE INVENTION

1. Field of the Invention

The present invention relates to a cutting equipment, and more particularly to a cutting equipment for cutting off workpieces from a material tape.

2. Description of the Prior Art

At present, during the process of manufacturing electronic components, every workpiece is commonly connected to a material tape, and a pre-cut section is configured between the workpiece and the material tape. When needing to use the workpiece, it is needed to bend up and down the pre-cut section for separating the workpiece from the material tape. To a certain extent, the pre-cut section can enhance the manufacture efficiency of assembling, but the manual operation can result in many problems such as the workpiece easy to be oxidized and deformed. As a result, the workpiece quality is difficult to be ensured and the defective rate of the workpiece is high. Moreover, the manual operation can increase the labor intensity of operators, therefore this prior operating mode has disadvantages of low productivity and high cost, and can not be suitable for mass production.

Hence, it is needed to provide a cutting equipment to solve above problems.

BRIEF SUMMARY OF THE INVENTION

An object of the present invention is to provide a cutting equipment, which can increase the production rate, reduce the defective rate of workpieces and the manufacture cost, lighten the labor intensity of operators and realize mass production.

To achieve the above object, in accordance with the present invention, a cutting equipment is provided for automatically cutting off workpieces from a material tape. The cutting equipment comprises an electrical control box, a base board, a material-feeding mechanism, a material-transferring mechanism, a material-pulling mechanism and a cutting mechanism. The base board is disposed above the electrical control box. The material-feeding mechanism includes a supporting bracket, a material disc and a disc-driving device, wherein a lower end of the supporting bracket is fixedly mounted on the base board, the material disc and the disc-driving device are fixedly mounted on an upper end of the supporting bracket, and the material disc is used to load the material tape together with the workpieces. The material-transferring mechanism is mounted on the base board and one end of the material-transferring mechanism is adjacent to the material-feeding mechanism, wherein the material-transferring mechanism includes a pad board, a first supporting board and a second supporting board, the first and second supporting boards are separately fixedly attached to two side walls of the pad board, and a first lower surface is formed on a top surface of the first supporting board and used as a tape-transferring rail for carrying the material tape. The material-pulling mechanism is disposed above the material-transferring mechanism and includes a driving component and a material-pulling component, wherein the material-pulling component is pivotally connected to the driving component, and the material-pulling component is detachably inserted into one position hole of the material tape on the tape-transferring rail. The cutting mechanism is mounted on the base board and is fixedly connected to the other end of material-transferring mechanism, wherein the cutting mechanism includes a lower supporting plate, an upper cutting plate and a transferring cylinder, the lower supporting plate is used for loading the material tape, the upper cutting plate disposes at least one cutting blade, the transferring cylinder drives the upper cutting plate to move up and down for driving the cutting blade to cut off the workpieces from the material tape.

Based on the above description, the cutting equipment as provided by the present invention can automatically cut off the metal shells of the material tape. Because of replacing the prior manual operation, the cutting equipment has many advantages of largely enhancing the working efficiency, reducing the defective rate of the workpieces and the manufacture cost, and lightening the labor intensity of operators. Moreover, the present cutting equipment can stably work, ensure the property of the workpieces and be suitable for mass production.

DETAILED DESCRIPTION OF THE PREFERRED EMBODIMENTS

The following embodiment with reference to the accompanying drawings now has been given for detail describing the technology, the feature, the object and the effect of the present invention.

Figure 1A:
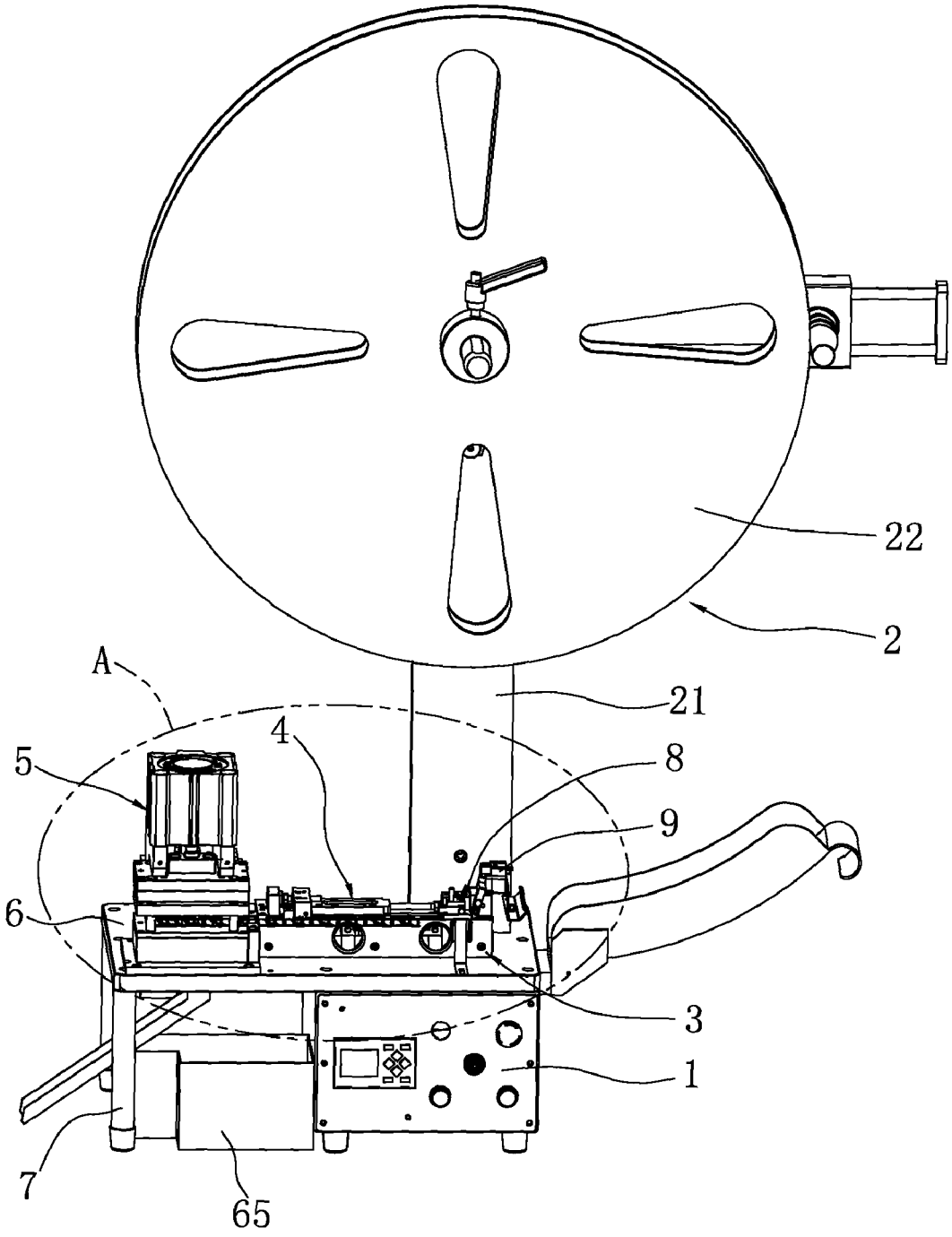
FIG. 1*a* is a structure schematic view of a cutting equipment according to one embodiment of the present invention.
Figure 1B:
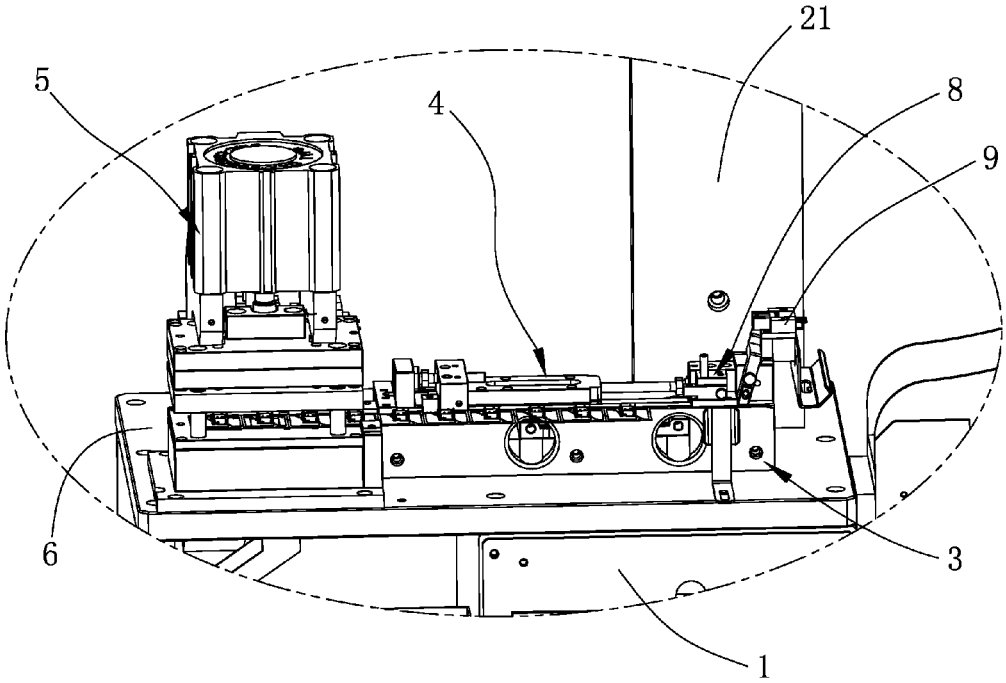
FIG. 1*b* is an enlarged view of part A in FIG. 1*a;*
Figure 2:
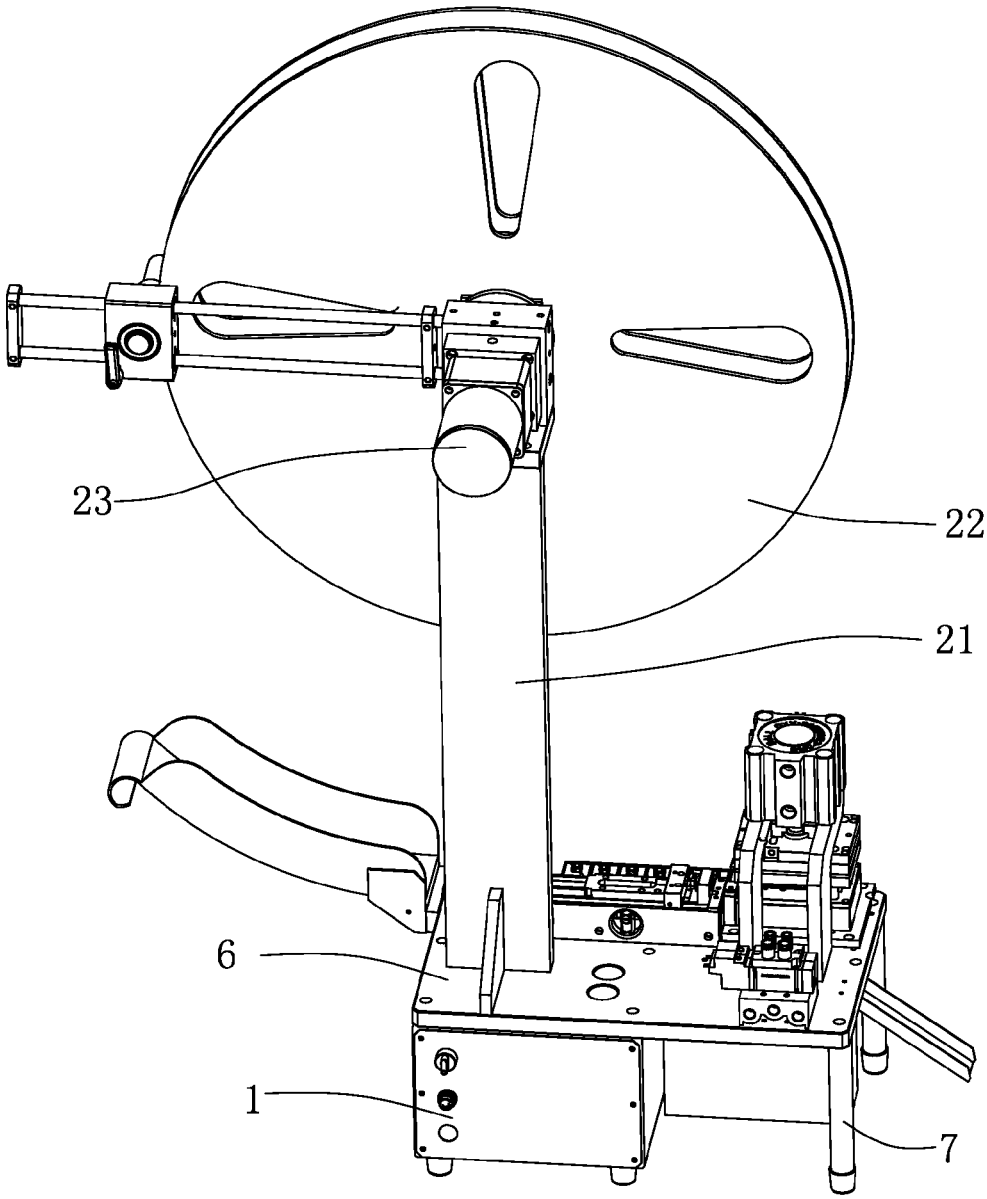
FIG. 2 is a structure schematic view for showing another direction structure of the cutting equipment in FIG. 1*a;*
Figure 3:
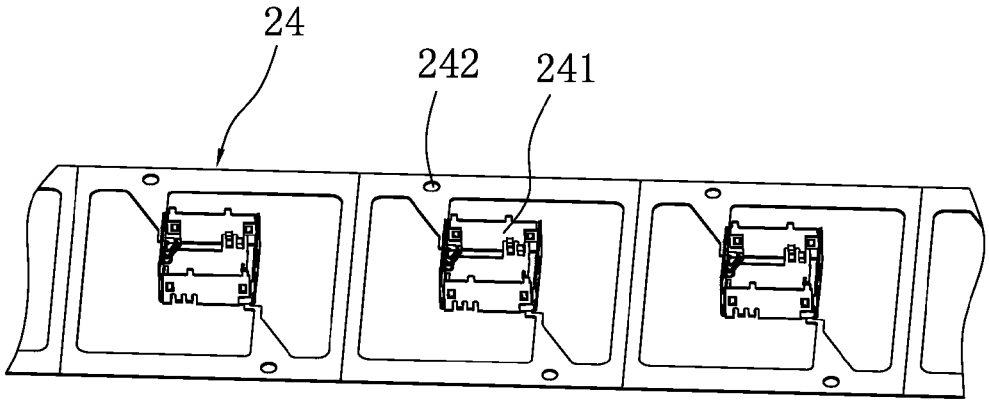
FIG. 3 is a structure schematic view of a material tape of the cutting equipment in FIG. 1*a;*

Referring to FIG. 1*a*, a cutting equipment of the present invention comprises an electrical control box 1, a base board 6, a material-feeding mechanism 2, a material-transferring mechanism 3, a material-pulling mechanism 4 and a cutting mechanism 5.

Please refer to FIGS. 1*a* to 3, the base board 6 is placed on the electrical control box 1, and the area of the base board 6 is larger than the area of the electrical control box 1 for loading the material-feeding mechanism 2, the material-transferring mechanism 3, the material-pulling mechanism 4 and the cutting mechanism 5. Two supporting posts 7 are disposed on the bottom surface of the base board 6, whereby the supporting posts 7 together with the electrical control box 1 can horizontally support the base board 6. The material-feeding mechanism 2 comprises a supporting bracket 21, a material disc 22 and a disc-driving device 23. A lower end of the supporting bracket 21 is fixed on the base board 6, and the material disc 22 and the disc-driving device 23 are fixedly mounted on an upper end of the supporting bracket 21. A material tape 24 including workpieces formed thereon is loaded on the material disc 22. Specifically, in the present invention, the workpieces connected to the material tape 24 are metal shells 241, and pluralities of position holes 242 are formed on two edges of the material tape 24. Selectably, the workpieces connected to the material tape 24 may be other elements, such as terminals.

Figure 4:
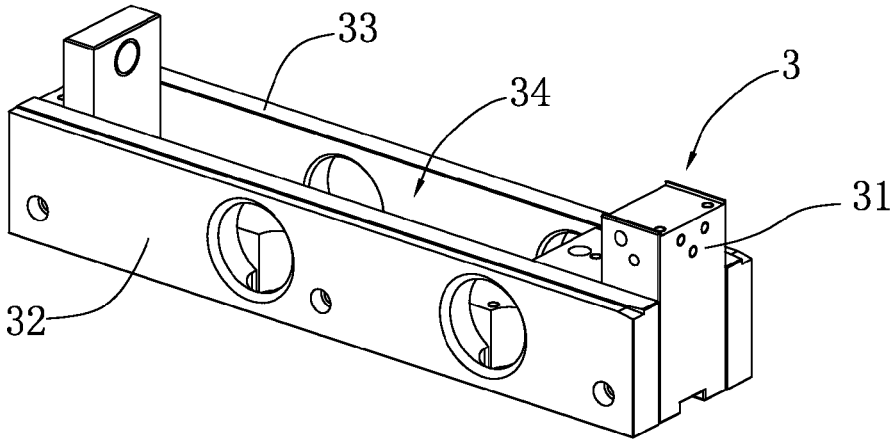
FIG. 4 is a structure schematic view of a material-transferring mechanism of the cutting equipment in FIG. 1*a;*
Figure 5:
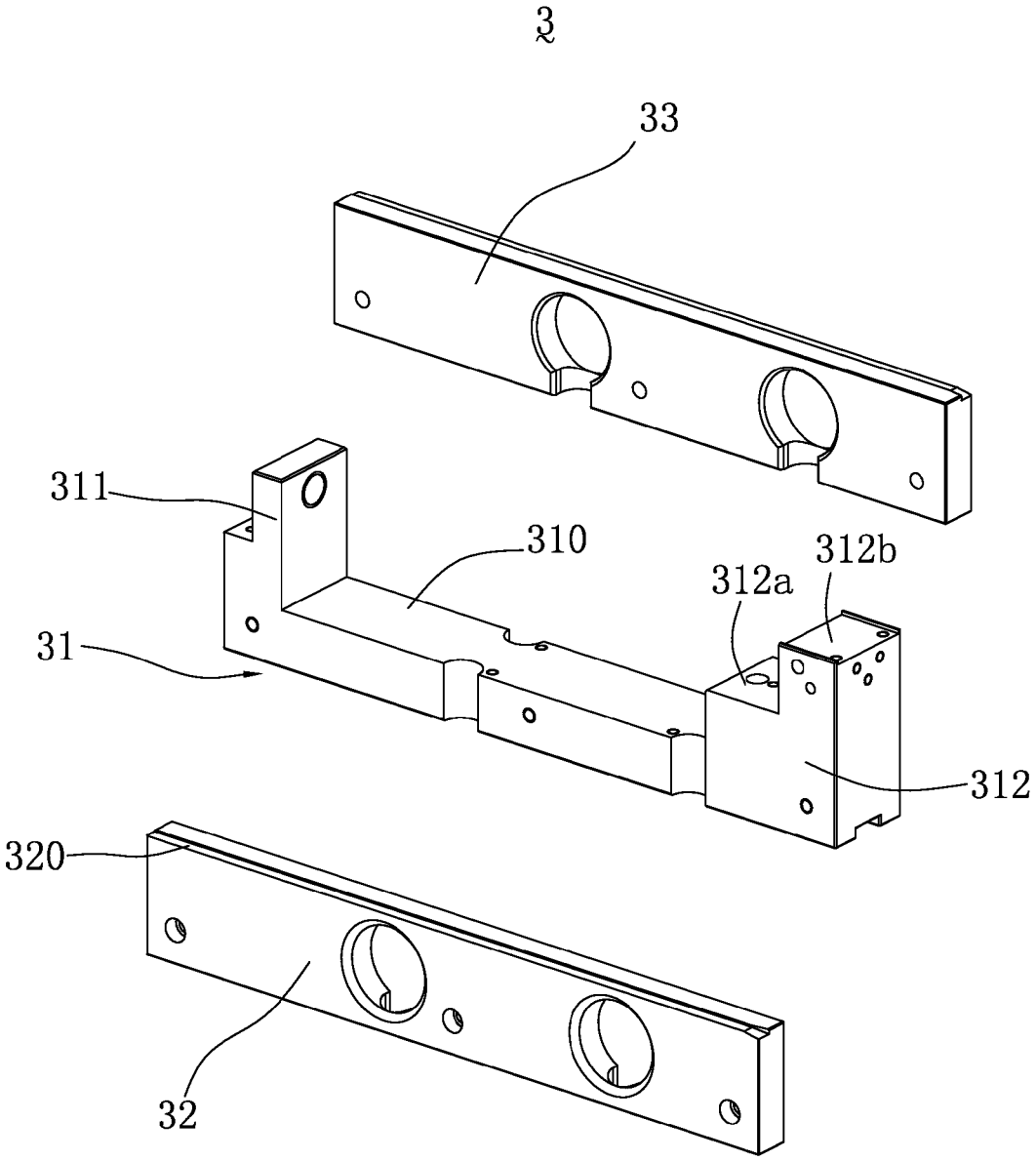
FIG. 5 is an exploded view of the material-transferring mechanism of FIG. 4.
Figure 6:
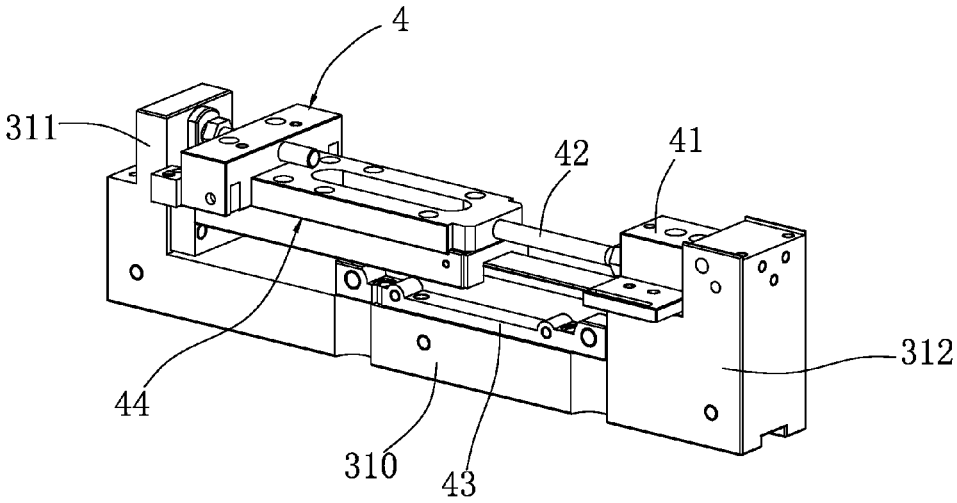
FIG. 6 is a structure schematic view of a material-pulling mechanism of the cutting equipment in FIG. 1*a;*

Referring to FIGS. 1*a*, 4 and 5, the material-transferring mechanism 3 is mounted on the base board 6, and one end of the material-transferring mechanism 3 is adjacent to the material-feeding mechanism 2. The material-transferring mechanism 3 comprises a pad board 31, a first supporting board 32 and a second supporting board 33. The first and second supporting boards 32, 33 are separately fixedly attached to two side walls of the pad board 31. A first lower surface 320 is formed on a top surface of the first supporting board 32 and is used as a tape-transferring rail for loading the material tape 24. The structure of the second supporting board 33 is same as that of the first supporting board 32. For example, the second supporting board 33 also has a second lower surface 330 formed on a top surface thereof and also used as a tape-transferring rail. The pad board 31 has a housing 310, a stop block 311 extending upward from one end of the housing 310, and a two-steps structure 312 extending upward from the other end of the housing 310. The two-steps structure 312 has a first step surface 312*a* and a second step surface 312*b* being higher than the first step surface 312*a*. The first and second supporting boards 32, 33 are located on a same level as the first step surface 312*a*. The stop block 311 and the second step surface 312*b* are located on a same level. A receiving cavity 34 is defined by the first and second supporting boards 32, 33 and the pad board 31.

Referring to FIGS. 1*a*, 6 to 7*c*, the material-pulling mechanism 4 comprises a driving component and a material-pulling component. The driving component includes a cylinder base 41, a material-feeding cylinder 42, a positioning block 43 and a sliding block 44. The cylinder base 41 is fixedly mounted on the first step surface 312*a* of the two-steps structure 312 and transversely covers the top surfaces of the first and second supporting boards 32, 33. The positioning block 43 is positioned in the receiving cavity 34 and is adjacent to the cylinder base 41. The sliding block 44 includes a first sliding block 441, a second sliding block 442 and a third sliding block 443. The first sliding block 441 is slidably connected to the positioning block 43. The top surfaces of the first sliding block 441 and the first and second supporting boards 32, 33 are located on a same level. The second sliding block 442 is fixedly mounted on an upper surface of the first sliding block 441. The third sliding block 443 is fixedly connected to one end of the second sliding block 442, and is located between the second sliding block 442 and the stop block 311. The third sliding block 443 disposes a groove 4431 facing to the first lower surface 320 of the first supporting board 32. The second sliding block 442 forms a cavity 4421 on the other end, facing to the cylinder base 41, of the second sliding block 442. One end of the material-feeding cylinder 42 is fixedly connected to the cylinder base 41, and the other end thereof is slidably connected to the cavity 4421. The material-pulling component includes a connecting block 45 and a material-pulling pin 46. The connecting block 45 has a first protruding portion 451, which is pivotally connected to the groove 4431 of the third sliding block 443 by a pivot shaft (not shown in all FIGS). An upper end of the material-pulling pin 46 is fixedly connected to the connecting block 45, and a lower end thereof is an inclined shape shown in FIG. 7*b* and has a tip 461. The tip 461 is detachably inserted into the position hole 242 of the material tape 24 for fixing the material tape 24. Because of the lower end of the material-pulling pin 46 being an inclined shape, the material-pulling pin 46 can only drive the material tape 24 to move forward. When the material-pulling pin 46 is moved backward, the inclined shape thereof can not drive the material tape 24 to move backward. Moreover, a securing bolt 47 used as a limit stop is connected to the third sliding block 443. One end of the securing bolt 47 passes through the third sliding block 443, and the other end thereof detachably contacts with the stop block 311. When the securing bolt 47 contacts with the stop block 311, a distance between the facing surfaces of the third sliding block 443 and the stop block 311 is a moving distance of the sliding block 44, and also is equal to a distance between two adjacent position holes 242 on the material tape 24. Therefore, when the dimension of the material tape 24 is changed, it is needed to adjust the position of the securing bolt 47 by unscrewing and screwing for corresponding to a new distance of two adjacent position holes 242 on the new material tape 24.

Figure 8:
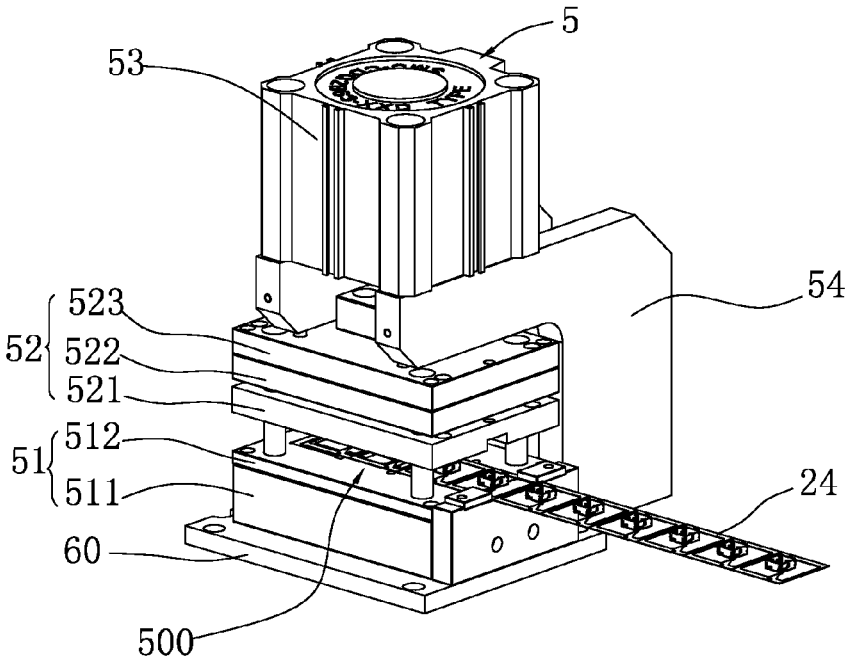
FIG. 8 is a structure schematic view of a cutting mechanism of the cutting equipment in FIG. 1*a;*
Figure 9:
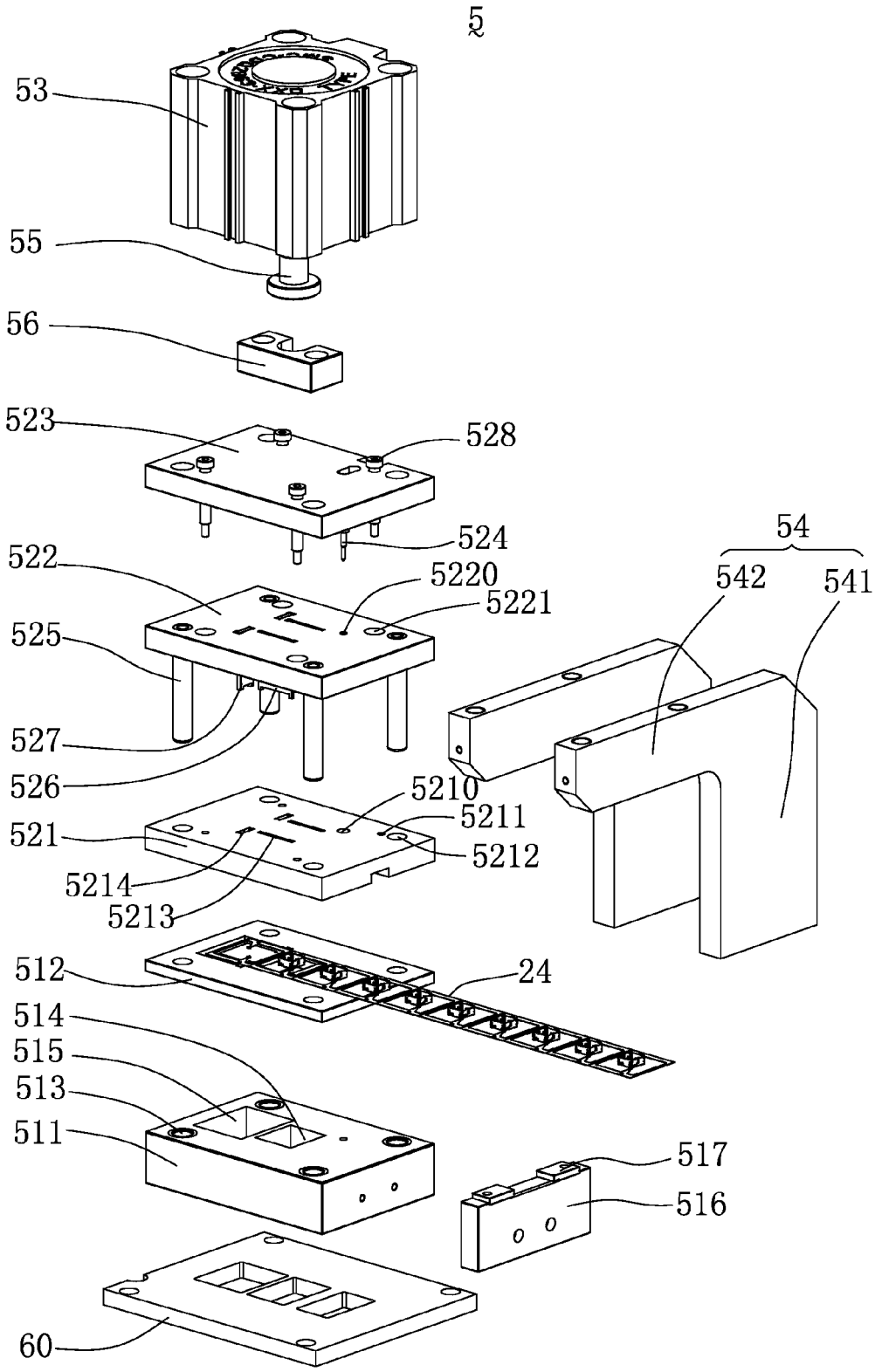
FIG. 9 is an exploded view of the cutting mechanism of FIG. 8.

Referring to FIGS. 1*a*, 8 and 9, the cutting mechanism 5 is mounted on the base board 6 and fixedly connected to the other end of the material-transferring mechanism 3. The cutting mechanism 5 includes a lower supporting plate 51, an upper cutting plate 52 and a transferring cylinder 53. A tape-cutting area 500 is formed between the lower supporting plate 51 and the upper cutting board 52. The lower supporting plate 51 includes a lower die base 511 and a lower die plate 512. The lower die base 511 is mounted on the base board 6 by a mounting board 60. One sidewall of the lower die base 511 is connected to the material-transferring mechanism 3 by a connecting plate 516. Two protruding blocks are formed on the connecting plate 516 for limiting the position of the material tape 24 transferred by the material-transferring mechanism 3. The lower die plate 512 is mounted on the lower die base 511. Both of the lower die base 511 and the lower die plate 512 dispose a guiding hole 513, a first material exit opening 514 and a second material exit opening 515. The upper cutting plate 52 is facing to the lower supporting plate 51 and includes, from upper to lower surface, an upper plate 521, an upper die base 522 and a mounting base 523. The mounting base 523 disposes a positioning pin 524 and several fasten screws 528. The upper die base 522 disposes a guiding post 525, a first cutting blade 526 and a second cutting blade 527. The fasten screws 528 are employed for fixedly connecting the upper plate 521, the upper die base 522 and the mounting base 523 together. The guiding post 525 is coupled to the guiding hole 513. The first and second cutting blades 526, 527 are separately facing to the first and second material exit openings 514, 515. Both of the upper die base 522 and the upper plate 521 form mounting holes 5220, 5221, 5210, 5211 corresponding to the positioning pin 524 and the fasten screws 528. The upper plate 521 forms slots 5212, 5213, 5214 corresponding to the guiding post 525, and the first and second cutting blades 526, 527. The positioning pin 524 and the fasten screws 528 separately pass through the mounting holes 5220, 5221 of the upper die base 522, and the mounting holes 5210, 5211 of the upper plate 521. The guiding post 525 and the first and second cutting blades 526 separately pass through the slots 5212, 5213, 5214 of the upper plate 521. And the positioning pin 524 passes through the position hole 242 (as labeled in FIG. 3) of the material tape 24 for fixing the material tape 24 to above the first and second material exit openings 514, 515.

The cutting mechanism 5 further includes a holding bracket 54 being an L-shaped. The holding bracket 54 has a vertical portion 541 and a horizontal portion 542. A lower end of the vertical portion 541 is fixedly mounted on the base board 6. The horizontal portion 542 is vertically connected to an upper end of the vertical portion 541 and is transversely located above the upper cutting plate 52. The transferring cylinder 53 is mounted on the horizontal portion 542 of the holding bracket 54. The transferring cylinder 53 has a transferring shaft 55, one end of which is slidably connected to the transferring cylinder 53, and the other end of which is fixedly connected to the upper cutting plate 52 by a pressure head holding member 56 and screws (not shown in all FIGS). The transferring cylinder 53 can drive the upper cutting plate 52 to move up and down thereby driving the first and second cutting blades 526, 527 to cut the material tape 24. Wherein the first cutting blade 526 is used to cut the metal shells 241 and the second cutting blade 527 is used to cut the material tape detached from the metal shells 241.

Figure 10:
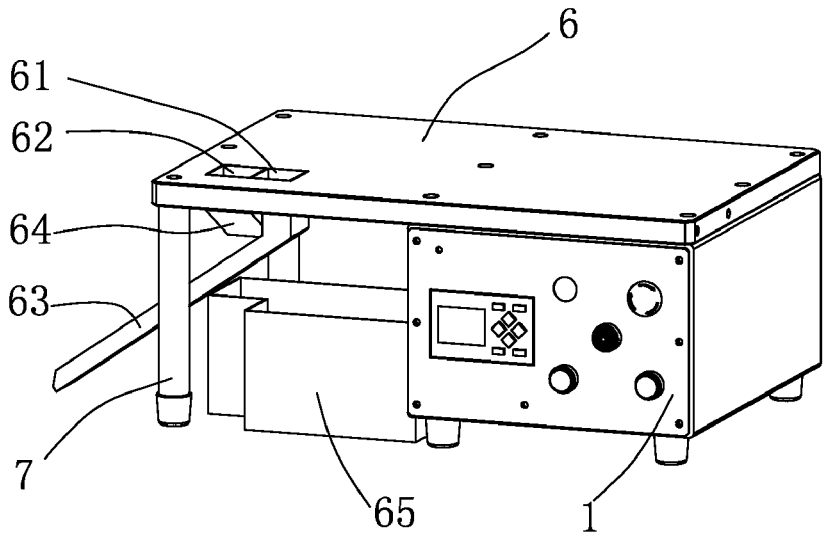
FIG. 10 is a structure schematic view of a base of the cutting equipment in FIG. 1*a;*

Referring to FIG. 10, the base board 6 forms first and second openings 61, 62 corresponding to the first and second material exit openings 514, 515. A first slide 63 and a second slide 64 are mounted on a bottom surface of the base board 6. The first slide 63 is connected to the first opening 61 so that the metal shells 241 can slide out from the first opening 61. The second slide 64 is connected to the second opening 62 so that the material tape detached from the metal shells 241 can slide out from the second opening 62. A collection box is located below the second slide 64 for collecting the material tape detached from the metal shells 241. In the present invention, the upper cutting plate 52 can be changed or replaced according to the type of the workpieces.

Figure 7A:
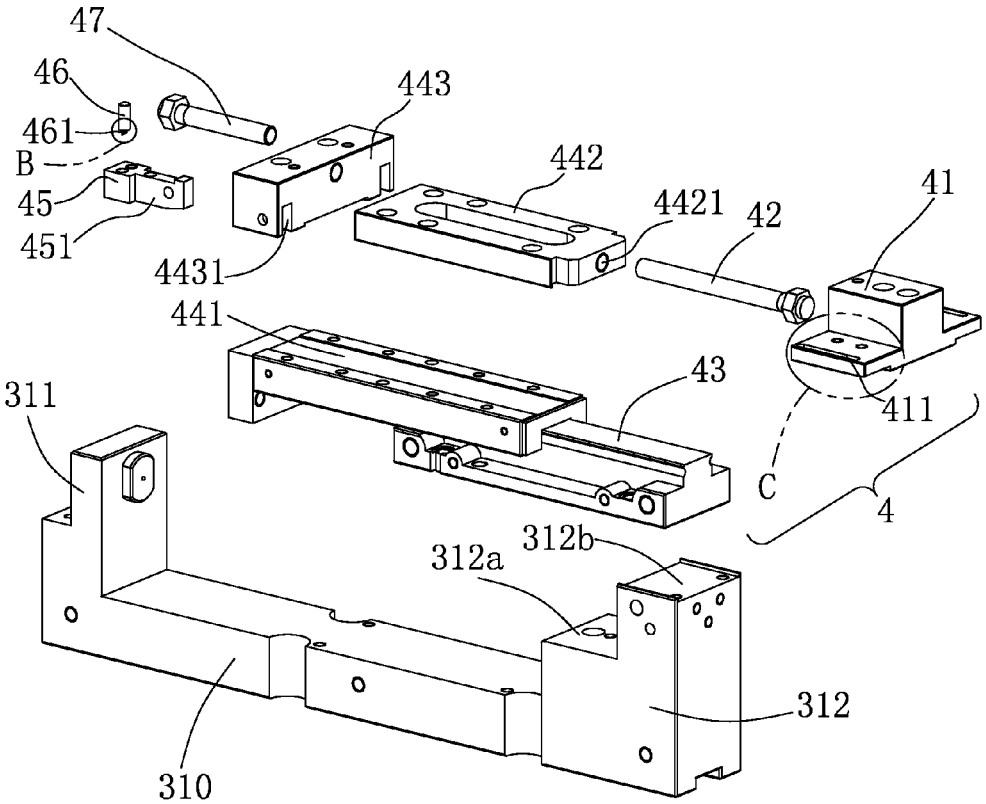
FIG. 7*a* is an exploded view of the material-pulling mechanism of FIG. 6.
Figure 7B:
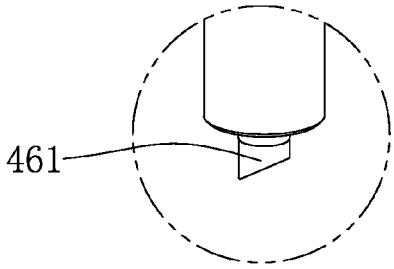
FIG. 7*b* is an enlarged view of part B in FIG. 7*a;*
Figure 7C:
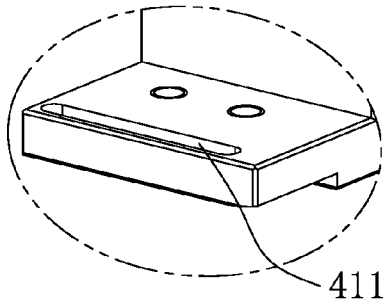
FIG. 7*c* is an enlarged view of part C in FIG. 7*a;*
Figure 11:
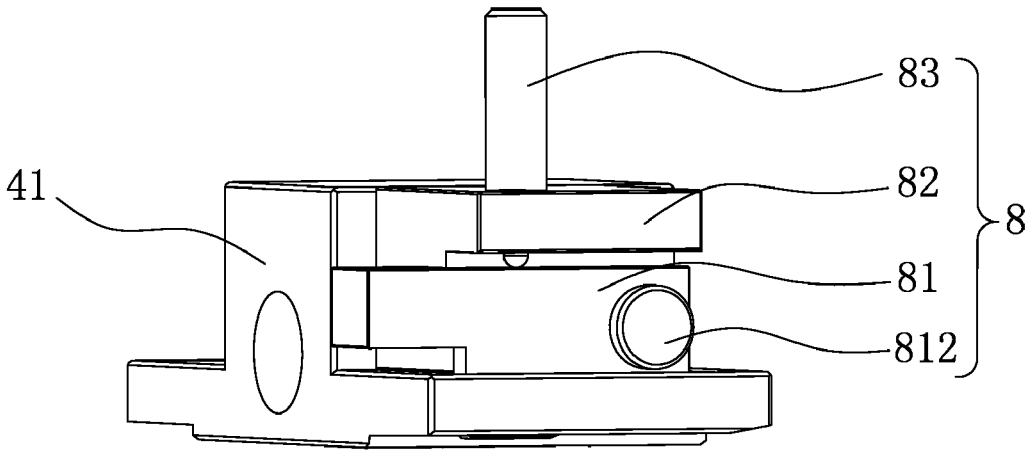
FIG. 11 is a structure schematic view of an anti-back mechanism of the cutting equipment in FIG. 1*a*.
Figure 12:
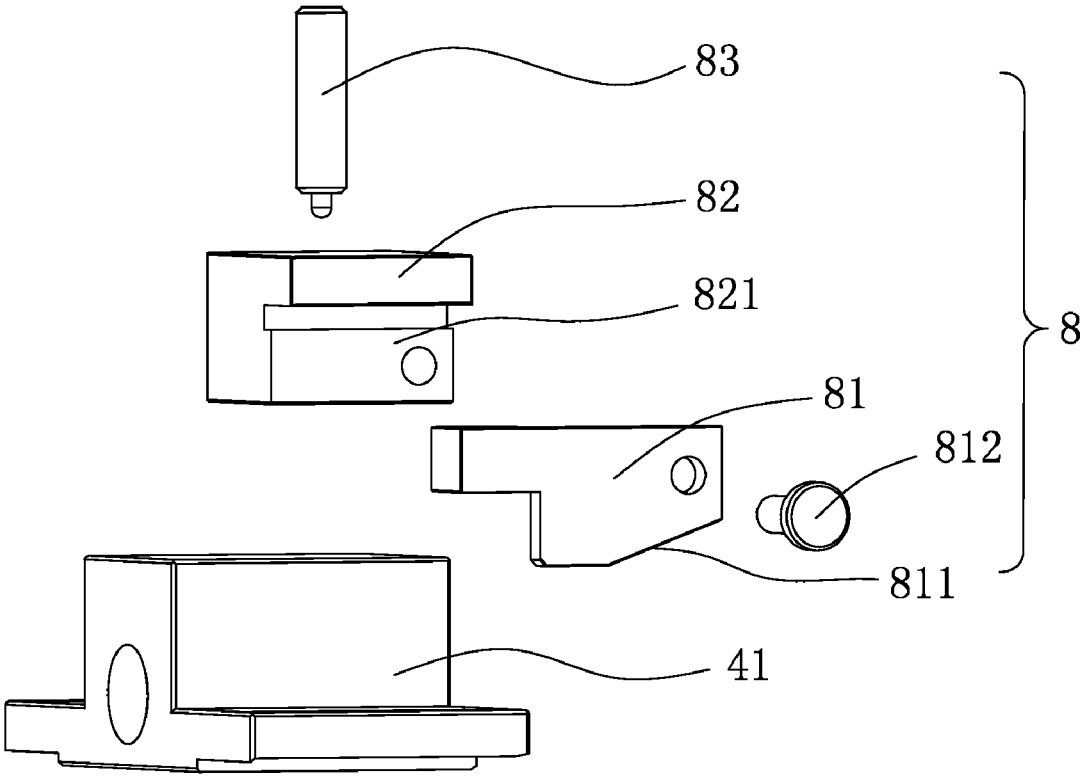
FIG. 12 is an exploded view of the anti-back mechanism of FIG. 11.

Referring to FIGS. 7*a*, 11 and 12, the cutting equipment of the present invention further comprises an anti-back mechanism 8, including an anti-back member 81, a positioning member 82 and a reset post 83. The anti-back mechanism 8 has an inclined structure 811 formed on a bottom surface thereof. The positioning member 82 is fixed to the cylinder base 41 and has a rearward surface 821. A long narrow slit 411 as shown in FIGS. 7*a* and 7*c* is formed on the cylinder base 41. The anti-back member 81 is pivotally connected to the rearward surface 821 by a screw 812, and the inclined structure 811 passes through the narrow slit 411. The reset post 83 passes through the positioning member 82 and then contacts with a top surface of the anti-back member 8. The working principle of the inclined structure 811 of the anti-back member 81 is same as that of the inclined shape of the material-pulling pin 46, namely the inclined structure 811 of the anti-back member 81 can prevent the material tape 24 from moving backward.

In one embodiment of the present invention, the cutting equipment further comprises a sensor device 9, which is mounted on the second step surface 312*b* of the pad board 31 for verifying whether the material tape 24 is transferred by the material-transferring mechanism 3. After the completion of transferring the material tape 24, the sensor device 9 transmits signals to the electrical control box 1 so that the electrical control box 1 can control the cutting equipment to stop working.

Referring to FIGS. 1*a* to 12, the working process of the cutting equipment of the present invention is described as follows: first, the material tape 24, which together with the metal shells 241 is loaded on the material disc 22, is placed onto the tape-transferring rails of the material-transferring mechanism 3, simultaneously the tip 461 of the material-pulling pin 46 is inserted into one position hole 241 of the material tape 24. Now the material-feeding cylinder 42 of the material-pulling mechanism 4 can start to work after receiving signals. The material-feeding cylinder 42 pushes the sliding block 44 to move toward the cutting mechanism 5, and the sliding block 44 brings along the material tape 24 to arrive at the cutting mechanism 5. Next, the material-feeding cylinder 42 drives the sliding block 44 to move toward the opposite direction of moving direction of the material tape 24, so that the tip 461 of the material-pulling pin 46 is inserted into a next one of the position holes 241 of the material tape 24. Specifically, when the sliding block 44 moves toward the opposite direction, the material-pulling pin 46 can rotate round the pivot shaft in the groove 4431 of the third sliding block 443 because the inclined shape of the material-pulling pin 46 is driven by the material tape 24, and the tip 461 of the material-pulling pin 46 can be raised and keep on contacting with an upper surface of the material tape 24 until the tip 461 arrives at the next one of the position holes 241. Now the tip 461 of the material-pulling pin 46 can be restored to the original state and be inserted into the next one position hole 241. When the sliding block 44 moves again toward the cutting mechanism 5, the material tape 24 can be again transferred to the cutting mechanism 5.

When the material-transferring mechanism 3 transfers the material tape 24 to above the first material exit opening 514 of the lower die plate, the transferring cylinder 53 drives the upper cutting plate 52 to move downward. During the upper cutting plate 52 moving downward, the positioning pin 524 firstly passes through one position hole 241 of the material tape 24 for fixing the material tape 24. Simultaneously, the guiding post 525 of the upper cutting plate 52 is sliding along the guiding hole 513 of the lower supporting plate 51 thereby driving the first cutting blade 526 of the upper cutting plate 52 to cut off one metal shell 241 from the material tape 24. The one metal shell 241 sequentially passes through the first material exit opening 514 and the first opening 61, and continues to slide out from the first slide 63. After cutting, the one metal shell 241 is separated from the material tape 24, and the transferring cylinder 53 drives the upper cutting plate 52 to move upward. The material tape 24 detached from the one metal shell 241 is transferred to above the second material exit opening 515. When the transferring cylinder 53 again drives the upper cutting plate 52 to move downward, the first and second cutting blades 526, 527 of the upper cutting plate 52 can simultaneously perform the cut action. Wherein the first cutting blade 526 can cut a next one metal shell 241 of the material tape 24, and the second cutting blade 527 can cut the material tape 24 detached from the previous one metal shell 241. After cutting, the next one shell 241 passes through the first material exit opening 514, the first opening 61 and the first slide 63 to slide out. The material tape 24 detached from the previous one metal shell 241 passes through the second material exit opening 515, the second opening 62 and the second slide 64 to slide out.

As described above, the cutting equipment of the present invention can automatically cut off the metal shells 241 of the material tape 24. Because of replacing the prior manual operation, the cutting equipment has many advantages of largely enhancing the working efficiency, reducing the defective rate of the workpieces and the manufacture cost, and lightening the labor intensity of operators. Moreover, the present cutting equipment can stably work, ensure the property of the workpieces and be suitable for mass production.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cutting equipment, for automatically cutting off workpieces from a material tape, comprising:

an electrical control box;

a base board, being disposed above the electrical control box;

a material-feeding mechanism, including a supporting bracket, a material disc and a disc-driving device, wherein a lower end of the supporting bracket is fixedly mounted on the base board, the material disc and the disc-driving device are fixedly mounted on an upper end of the supporting bracket, and the material disc is used to load the material tape together with the workpieces;

a material-transferring mechanism, being mounted on the base board and one end the material-transferring mechanism being adjacent to the material-feeding mechanism, wherein the material-transferring mechanism includes a pad board, a first supporting board and a second supporting board, the first and second supporting boards are separately fixedly attached to two side walls of the pad board, and a first lower surface is formed on a top surface of the first supporting board and used as a tape-transferring rail for carrying the material tape;

a material-pulling mechanism, being disposed above the material-transferring mechanism and including a driving component and a material-pulling component, wherein the material-pulling component is pivotally connected to the driving component, and the material-pulling component is detachably inserted into one position hole of the material tape on the tape-transferring rail; and a cutting mechanism, being mounted on the base board and being fixedly connected to the other end of material-transferring mechanism, wherein the cutting mechanism includes a lower supporting plate, an upper cutting plate and a transferring cylinder, the lower supporting plate is used for loading the material tape, the upper cutting plate disposes at least one cutting blade, the transferring cylinder drives the upper cutting plate to move up and down for driving the cutting blade to cut off the workpieces from the material tape.

2. The cutting equipment as claimed in claim 1, wherein the pad board includes a housing, a stop block extending upward from one end of the housing, and a two-steps structure extending upward from the other end thereof; the two-steps structure has a first step surface and a second step surface being higher than the first step surface; the first and second supporting boards are located on a same level as the first step surface; the stop block and the second step surface are located on a same level; and a receiving cavity is defined by the first and second supporting boards and the pad board.

3. The cutting equipment as claimed in claim 2, wherein the driving component includes a cylinder base, a material-feeding cylinder, a positioning block and a sliding block; the cylinder base is fixedly mounted on the first step surface of the two-steps structure and transversely covers the top surfaces of the top surfaces of first and second supporting boards; the positioning block is positioned in the receiving cavity and is adjacent to the cylinder base; the sliding block includes a first sliding block slidably connected to the positioning block, a second sliding block fixedly mounted above the first sliding block, and a third sliding block fixedly connected to one end of the second sliding block and located between the second sliding block and the stop block; the second sliding block forms a cavity on the other end of the second sliding block facing to the cylinder base; one end of the material-feeding cylinder is fixedly connected to the cylinder base, and the other end thereof is slidably connected to the cavity of the second sliding block.

4. The cutting equipment as claimed in claim 3, wherein the third sliding block disposes a groove facing to the first lower surface of the first supporting board; the material-pulling component includes a connecting block and a material-pulling pin; the connecting block has a first protruding portion pivotally connected to the groove of the third sliding block; an upper end of the material-pulling pin is fixedly connected to the connecting block, and a lower end thereof is an inclined shape and has a tip being capable of detachably inserted into one position hole of the material tape on the tape-transferring rail.

5. The cutting equipment as claimed in claim 3, further comprising an anti-back mechanism including an anti-back member, a positioning member and a reset post, wherein the anti-back mechanism has an inclined structure formed on a bottom surface thereof; the positioning member is fixed to the cylinder base and has a rearward surface; a long narrow slit is formed on the cylinder base; the anti-back member is pivotally connected to the rearward surface; the inclined structure passes through the narrow slit; the reset post passes through the positioning member to contact with a top surface of the anti-back member.

6. The cutting equipment as claimed in claim 3, further comprising a limit stop fixedly connected to the third sliding block, wherein one end of the limit stop detachably contacts with the stop block, when the limit stop contacts with the stop block, a distance between the facing surfaces of the third sliding block and the stop block is a moving distance of the sliding block, and also is equal to a distance between two adjacent position holes on the material tape.

7. The cutting equipment as claimed in claim 2, further comprising a sensor device, which is mounted on the second step surface of the pad board for verifying whether the material tape is transferred by the material-transferring mechanism.

8. The cutting equipment as claimed in claim 1, wherein the cutting mechanism further includes a holding bracket, the transferring cylinder is mounted on the holding bracket and located above the upper cutting plate; the transferring cylinder has a transferring shaft, one end of which is slidably connected to the transferring cylinder, and the other end of which is fixedly connected to the upper cutting plate; the upper cutting plate disposes a guiding post; the lower supporting plate forms a guiding hole coupled with the guiding post and at least one material exit opening corresponding to the cutting blade of the upper cutting plate.

9. The cutting equipment as claimed in claim 8, wherein the holding bracket is an L-shape having a vertical portion and a horizontal portion, a lower end of the vertical portion is fixedly mounted on the base board, and the horizontal portion is vertically connected to an upper end of the vertical portion and is transversely located above the upper cutting plate.

10. The cutting equipment as claimed in claim 8, wherein the base board forms at least one opening, which is corresponding to the material exit opening and is provided for the workpieces cut off sliding out from the material exit opening.

* * * * *